US010696442B2

(12) United States Patent
Sin

(10) Patent No.: US 10,696,442 B2
(45) Date of Patent: Jun. 30, 2020

(54) ONE PIECE TELESCOPING GRAPHIC BLOCK PACKAGING

(71) Applicant: WestRock Shared Services, LLC, Atlanta, GA (US)

(72) Inventor: Alexander C. Sin, Winston-Salem, NC (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/108,235

(22) Filed: Aug. 22, 2018

(65) Prior Publication Data

US 2019/0061990 A1 Feb. 28, 2019

Related U.S. Application Data

(60) Provisional application No. 62/549,984, filed on Aug. 25, 2017.

(51) Int. Cl.

| | |
|---|---|
| ***B65D 5/355*** | (2006.01) |
| ***B65D 5/22*** | (2006.01) |
| ***B65D 5/42*** | (2006.01) |
| ***B65D 5/32*** | (2006.01) |
| ***B65D 5/38*** | (2006.01) |
| ***B65D 5/52*** | (2006.01) |

(52) U.S. Cl.

CPC ..... *B65D 5/321* (2013.01); *B65D 5/0005* (2013.01); *B65D 5/22* (2013.01); *B65D 5/38* (2013.01); *B65D 5/4216* (2013.01); *B65D 5/52* (2013.01)

(58) Field of Classification Search

CPC ..... B65D 21/086
USPC ..... 229/129
See application file for complete search history.

(56) References Cited

U.S. PATENT DOCUMENTS

| | | | | |
|---|---|---|---|---|
| 3,107,042 | A * | 10/1963 | Keith | B65D 5/0218 229/101 |
| 3,886,901 | A * | 6/1975 | Zeitter | A01K 1/0125 119/168 |
| 2015/0144686 | A1* | 5/2015 | Miranda | B65D 5/0005 229/101 |
| 2016/0229581 | A1* | 8/2016 | Smith | B65D 5/0005 |
| 2017/0144792 | A1* | 5/2017 | Block | B65D 5/0005 |
| 2017/0360222 | A1* | 12/2017 | Saladyga | A47F 5/114 |

* cited by examiner

*Primary Examiner* — Nathan J Newhouse
*Assistant Examiner* — Phillip D Schmidt
(74) *Attorney, Agent, or Firm* — WestRock IP Legal

(57) ABSTRACT

A telescoping graphic block package includes a tray configured to package and display product placed therein. A graphic block is slidingly connected to the tray for telescoping relative to the tray along a telescoping axis. A set of folding panels connects the tray to the graphic block. The tray can include a bottom panel and two side panels on either end of the bottom panel. The side panels can be opposed to one another along the telescoping axis. A back panel can be connected to the bottom panel. A front panel can be connected to the bottom panel across from the back panel relative to the telescoping axis. The graphic block can include a front panel, a top panel, and side panel orthogonal to both the front panel and the top panel, wherein the side panel of the graphic block is normal to the telescoping axis.

8 Claims, 4 Drawing Sheets

Fig. 2
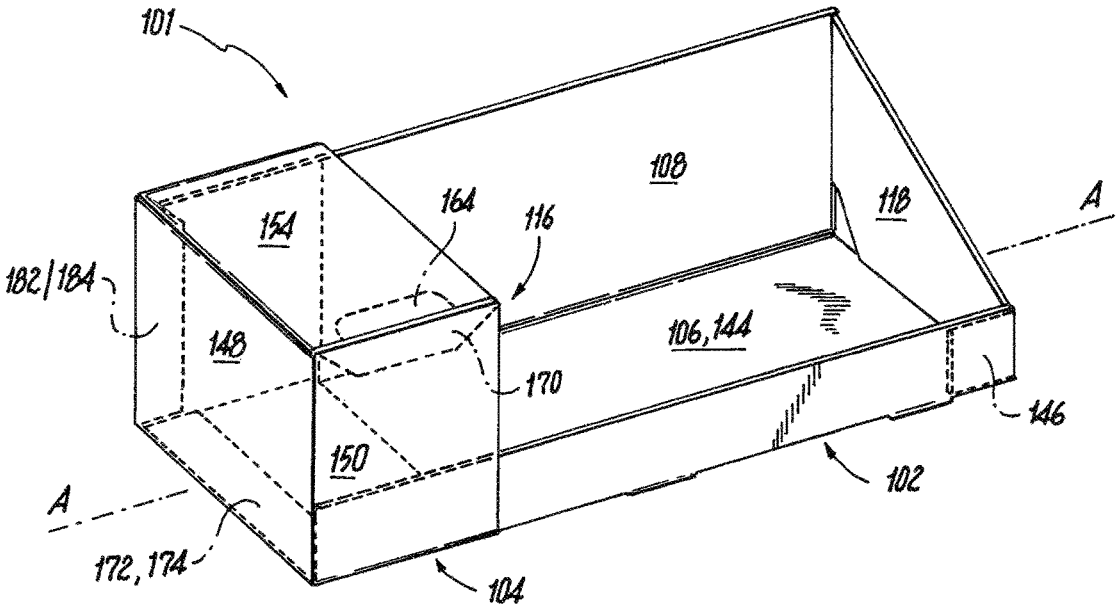
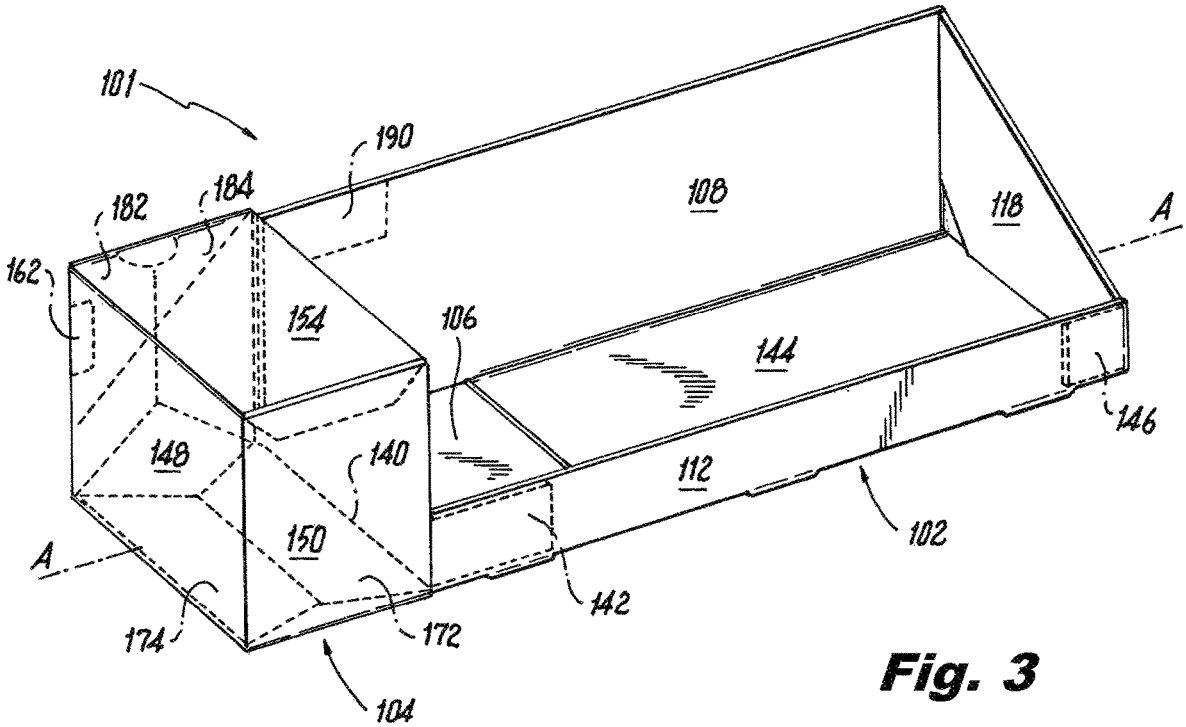
Fig. 3

Fig. 5
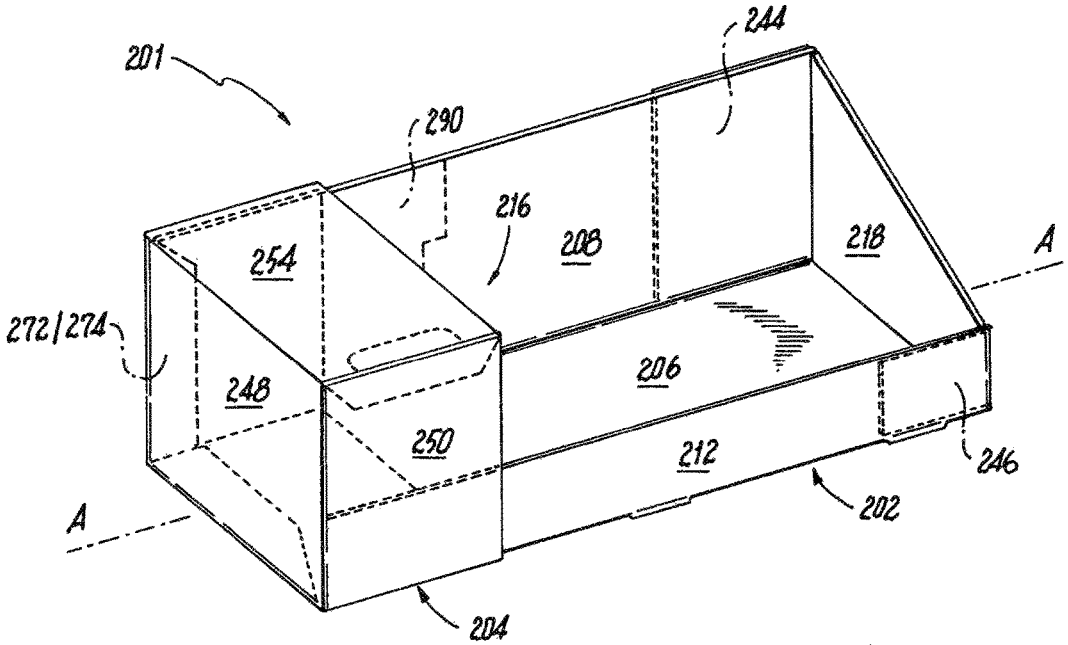
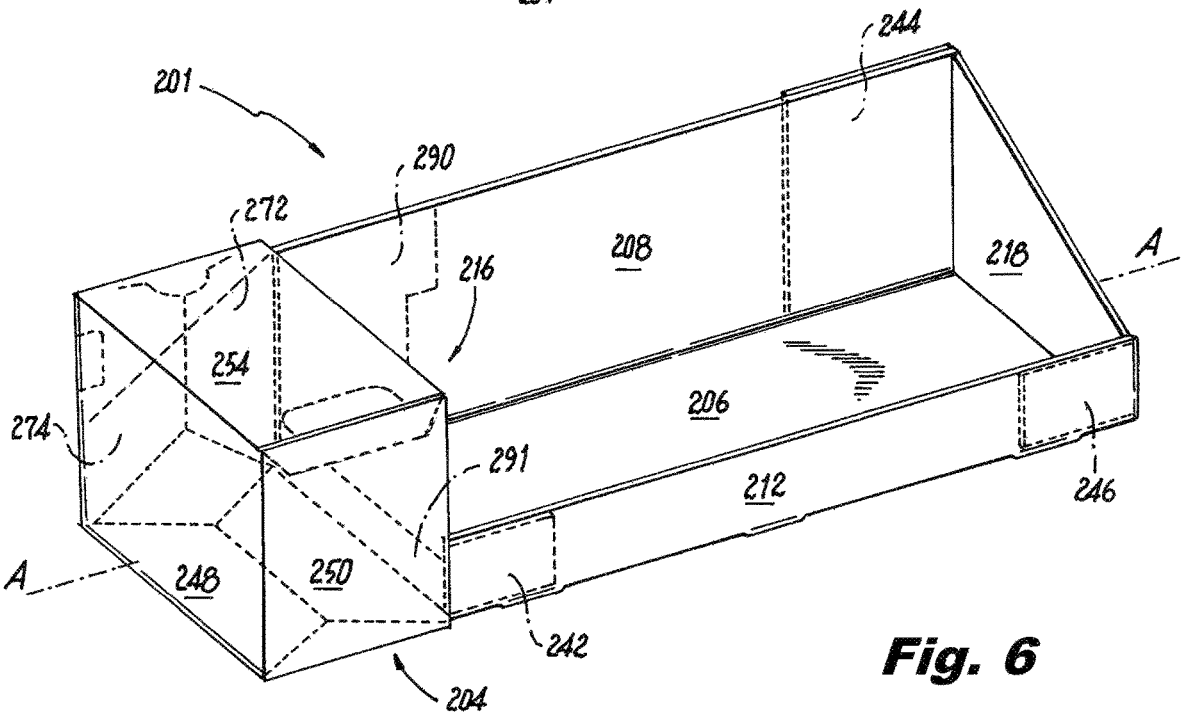
Fig. 6

ONE PIECE TELESCOPING GRAPHIC BLOCK PACKAGING

REFERENCE TO RELATED APPLICATION

This application claims the benefit of priority under 35 U.S.C. § 119(e) of U.S. provisional application Ser. No. 62/549,984 filed on Aug. 25, 2017, which is hereby incorporated by reference in its entirety.

BACKGROUND OF THE INVENTION

1. Field of the Invention

The present disclosure relates to packaging such as for retail display, and more particularly to packaging with telescoping graphic blocks.

2. Description of Related Art

In retail settings, it is often desirable to display goods for sale within their packaging, as opposed to using packaging that conceals the goods completely. In packaging that displays the goods within the package, it is desirable to have graphics on the packaging to enhance the display within the retail setting. The graphics can show images the product in use for example. It is advantageous if the display packaging, including the graphics, can be used for shipping as well as for display in the retail setting. One configuration that provides a compact shipping volume, and an increased retail volume with graphics is the telescoping graphic block container. The combination of a packaging tray and a graphic block are shipped in a compact form, and then in the retail setting, the graphic block is telescopically expanded to reveal the product in the tray while also providing the retail graphics. While such packaging is desirable for its shipping and retail advantages, traditional telescoping graphic block packages are complex and costly to manufacture. Some designs require up to six separate components to be manufactured and assembled together to make the telescoping graphic block function.

The conventional techniques have been considered satisfactory for their intended purpose. However, there is an ever present need for improved packaging. This disclosure provides a solution for this problem.

SUMMARY OF THE INVENTION

A telescoping graphic block package includes a tray configured to package and display product placed therein. A graphic block is slidingly connected to the tray for telescoping relative to the tray along a telescoping axis. A set of folding panels connects the tray to the graphic block.

The tray can include a bottom panel and two side panels on either end of the bottom panel. The side panels can be opposed to one another along the telescoping axis. A back panel can be connected to the bottom panel. A front panel can be connected to the bottom panel across from the back panel relative to the telescoping axis. The graphic block can include a front panel, a top panel, and side panel orthogonal to both the front panel and the top panel, wherein the side panel of the graphic block is normal to the telescoping axis.

The set of folding panels can include a pair of folding panels connected to each other along a fold line. A first one of the folding panels in the pair can be connected to a bottom panel of the tray along a fold line. A second one of the folding panels in the pair can be connected to a side panel of the graphic block, the side panel of the graphic block being oriented normal to the telescoping axis, so that the pair of folding panels unfolds in accordion expansion as the graphic block slides to telescopically expand along the telescoping axis.

It is also contemplated that the set of folding panels can include a pair of folding panels connected to each other along a fold line wherein a first one of the folding panels in the pair is connected to a back panel of the tray along a fold line. A second one of the folding panels in the pair can be connected to a side panel of the graphic block so that the pair of folding panels unfolds in accordion expansion as the graphic block slides to telescopically expand along the telescoping axis.

The first pair of folding panels can form a bottom panel of the graphic block with the folding panels unfolded. The second pair of folding panels can form a back panel of the graphic block with the folding panels unfolded. The tray and graphic block can be integrally connected together by the set of folding panels as one piece.

A blank for a telescoping graphic block package includes a plurality of panels for forming a tray configured to package and display product placed therein. A plurality of panels are included for forming a graphic block slidingly connected to the tray for telescoping relative to the tray along a telescoping axis. A set of folding panels connects the tray to the graphic block.

The tray can include a bottom panel, a back panel connected to the bottom panel along a fold line, and a front panel connected to the bottom panel along a fold line across from the back panel, and two side panels on opposite sides of the bottom panel. The graphic block can include a side panel, a front panel connected to the side panel along a fold line, and a top panel connected to the side panel along a fold line such that when the blank is formed into the package, the side panel is orthogonal to both the front panel and the top panel, wherein the side panel of the graphic block is normal to a telescoping axis of the package. The tray and graphic block can be integrally connected together by the set of folding panels as one piece.

The set of folding panels can include a first pair of folding panels connected to each other along a fold line, wherein a first one of the folding panels in the first pair is connected to a bottom panel of the tray along a fold line, and wherein a second one of the folding panels in the pair is connected to a side panel of the graphic block along a fold line so that the pair of folding panels unfolds in accordion expansion as the graphic block slides to telescopically expand along the telescoping axis. The set of folding panels can include a second pair of folding panels connected to each other along a fold line, wherein a first one of the folding panels in the second pair is connected to a side panel of the graphic block along a fold line, and a second one of the folding panels in the second pair is connected to a flap configured to be connected to a back panel of the tray.

The first pair of folding panels can be configured to form a bottom panel of the graphic block with the folding panels unfolded. The second pair of folding panels can be configured to form a back panel of the graphic block with the folding panels unfolded.

The set of folding panels can include a pair of folding panels connected to each other along a fold line, wherein a first one of the folding panels in the pair is connected to a back panel of the tray along a fold line, and wherein a second one of the folding panels in the pair is connected to a side panel of the graphic block so that the pair of folding panels unfolds in accordion expansion as the graphic block slides to telescopically expand along the telescoping axis. The set of folding panels can include a second pair of folding panels connected to each other along a fold line, wherein a first one of the folding panels in the second pair is connected to the side panel of the graphic block along a fold line, and wherein a second one of the folding panels in the second pair is configured to be connected to a bottom panel and/or a side panel of the tray.

The second pair of folding panels can be configured to form a bottom panel of the graphic block with the folding panels unfolded. The first pair of folding panels can be configured to form a back panel of the graphic block with the folding panels unfolded.

A method of forming a telescoping graphic block package from a blank includes forming a tray and a graphic block from a single blank, wherein the graphic block is slidingly connected to the tray for telescoping relative to the tray along a telescoping axis, wherein the tray and the graphic block are integrally connected to each other along at least one fold line. Forming the tray and graphic block can include accordion folding a first pair of folding panels to cover a portion of the tray with the graphic block in an unexpanded position, wherein the first pair of folding panels is integrally connected to the tray and to the graphic block along respective fold lines. Forming the tray and graphic block can include accordion folding a second pair of folding panels, wherein the second pair of folding panels is only integrally connected to the tray and to the graphic block along a respective fold line, and is adhered to the other of the tray and graphic block.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 2 is a schematic perspective view of a package assembled from the blank of FIG. 1, showing the graphic box in the compact shipping configuration;

FIG. 3 is a schematic perspective view of the package of FIG. 2, showing the graphic block telescoped out in the retail configuration;

FIG. 5 is a schematic perspective view of a package assembled from the blank of FIG. 4, showing the graphic box in the compact shipping configuration; and FIG. 6 is a schematic perspective view of the package of FIG. 5, showing the graphic block telescoped out in the retail configuration.

DETAILED DESCRIPTION OF THE PREFERRED EMBODIMENTS

Figure 1:
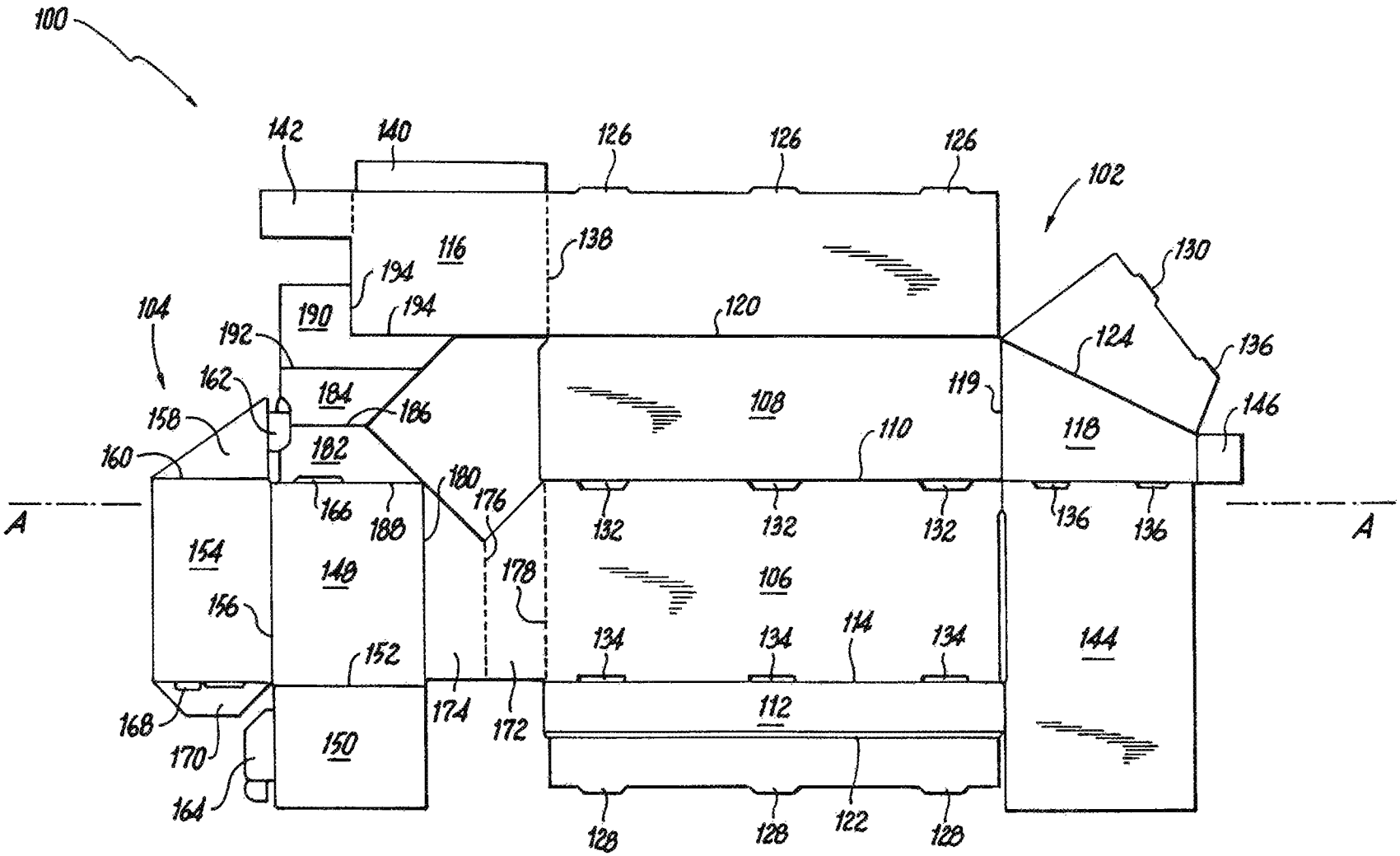
FIG. 1 is a plan view of an exemplary embodiment of a package blank constructed in accordance with the present disclosure, showing the telescoping panels.

Reference will now be made to the drawings wherein like reference numerals identify similar structural features or aspects of the subject disclosure. For purposes of explanation and illustration, and not limitation, a partial view of an exemplary embodiment of a blank for a package in accordance with the disclosure is shown in FIG. 1 and is designated generally by reference character 100. Other embodiments of blanks and packages in accordance with the disclosure, or aspects thereof, are provided in FIGS. 2-6, as will be described. The systems and methods described herein can be used to provide one-piece telescoping graphic display packaging for shipping and displaying product, e.g., in a retail setting.

The blank 100 for a telescoping graphic block package 101, shown assembled in FIGS. 2-3, includes a plurality of panels for forming a tray 102 and a graphic block 104 slidingly connected to the tray 102 for telescoping relative to the tray along a telescoping axis A. The tray 102 is configured to package and display product placed therein, e.g. in a retail setting so buyers can see the product. The tray 102 includes a bottom panel 106, a back panel 108 connected to the bottom panel 106 along a fold line 110. A front panel 112 is connected to the bottom panel 106 along a fold line 114 across from the back panel 108. Two side panels 116 and 118 are included on opposite sides of the bottom panel 106. Back, front, and side panels 106, 108, and 118 are each compound panels including a respective fold line 120, 122, and 124 which can be folded to form a respective double panel. Each of the back, front, and side panels 106, 108, and 118 includes a respective set of tabs 126, 128, and 130 which are seated in respective slots 132, 134, and 136 when the package 101 is assembled.

Side panel 116 is connected to back panel 108 along fold line 138, and includes tabs 140 and 142 which are assembled and/or adhered to the bottom panel 106 and within the front panel 112, respectively, as shown in FIG. 3. The other side panel 118 similarly includes a bottom tab 144 and a front tab 146 which are assembled and/or adhered to the bottom panel 106 and front panel 112, as shown in FIG. 3.

The graphic block 104 includes a side panel 148, a front panel 150 connected to the side panel 148 along a fold line 152, and a top panel 154 connected to the side panel 148 along a fold line 156 such that when the blank 100 is formed into the package 101, the side panel 148 is orthogonal to both the front panel 150 and the top panel 154. The side panel 148 of the graphic block 104 is normal to the telescoping axis A of the package 101, as shown in FIGS. 2-3. A back panel 158 is connected to the top panel 154 along a fold line 160. Tabs 162 and 164 are assembled and/or adhered into slots 166 and 168, respectively, as indicated in FIGS. 2-3, to hold the form of the graphic block 104. Tab 170 is similarly tucked and/or adhered inside the graphic block 104, as shown in FIGS. 2-3.

A set of folding panels connects the tray 102 to the graphic block 104. The set of folding panels includes a first pair of folding panels 172 and 174 connected to each other along a fold line 176, wherein a first one of the folding panels 172 is integrally connected to the bottom panel 106 of the tray 102 along a fold line 178. A second one of the folding panels 174 is connected to the side panel 148 of the graphic block 102 along a fold line 180 so that the pair of folding panels 172 and 174 unfolds in accordion expansion as the graphic block 104 slides relative to tray 102 to telescopically expand along the telescoping axis A. The tray 102 and graphic block 104 are integrally connected together in this manner by the set of folding panels as one piece. FIG. 2 shows the compact position of graphic block 104, and FIG. 3 shows the telescoped, expanded position of graphic block 104.

The set of folding panels also includes a second pair of folding panels 182 and 184 connected to each other along a fold line 186. A first one of the folding panels 182 is connected to the side panel 148 of the graphic block along a fold line 188. The second one of the folding panels 184 is connected to a flap 190 along fold line 192. Flap 190 can be separated from the side panel 116 of the tray 102 by a cut line 194 that is configured to be connected to a back panel 108 of the tray 102. Flap 192 can be assembled and/or adhered into back panel 108, e.g., between the two portions of the double panel as indicated in FIG. 3, or assembled/adhered to back panel 108 or side panel 116 of the tray 102.

The first pair of folding panels 172 and 174 forms a bottom panel of the graphic block 104 with the folding panels unfolded as shown in FIG. 3. The second pair of folding panels 182 and 184 forms a back panel of the graphic block 104 with the folding panels unfolded as shown in FIG. 3. As the graphic block 104 is slid telescopically relative to tray 102 along the telescoping axis A from the compact position shown in FIG. 2 to the expanded position shown in FIG. 3, the folding panels 172, 174, 182, and 184 expand in accordion expansion. In forming package 101 from blank 100, the folding panels 172, 174, 182, and 184 are accordion folded into the compact configuration shown in FIG. 2.

Figure 4:
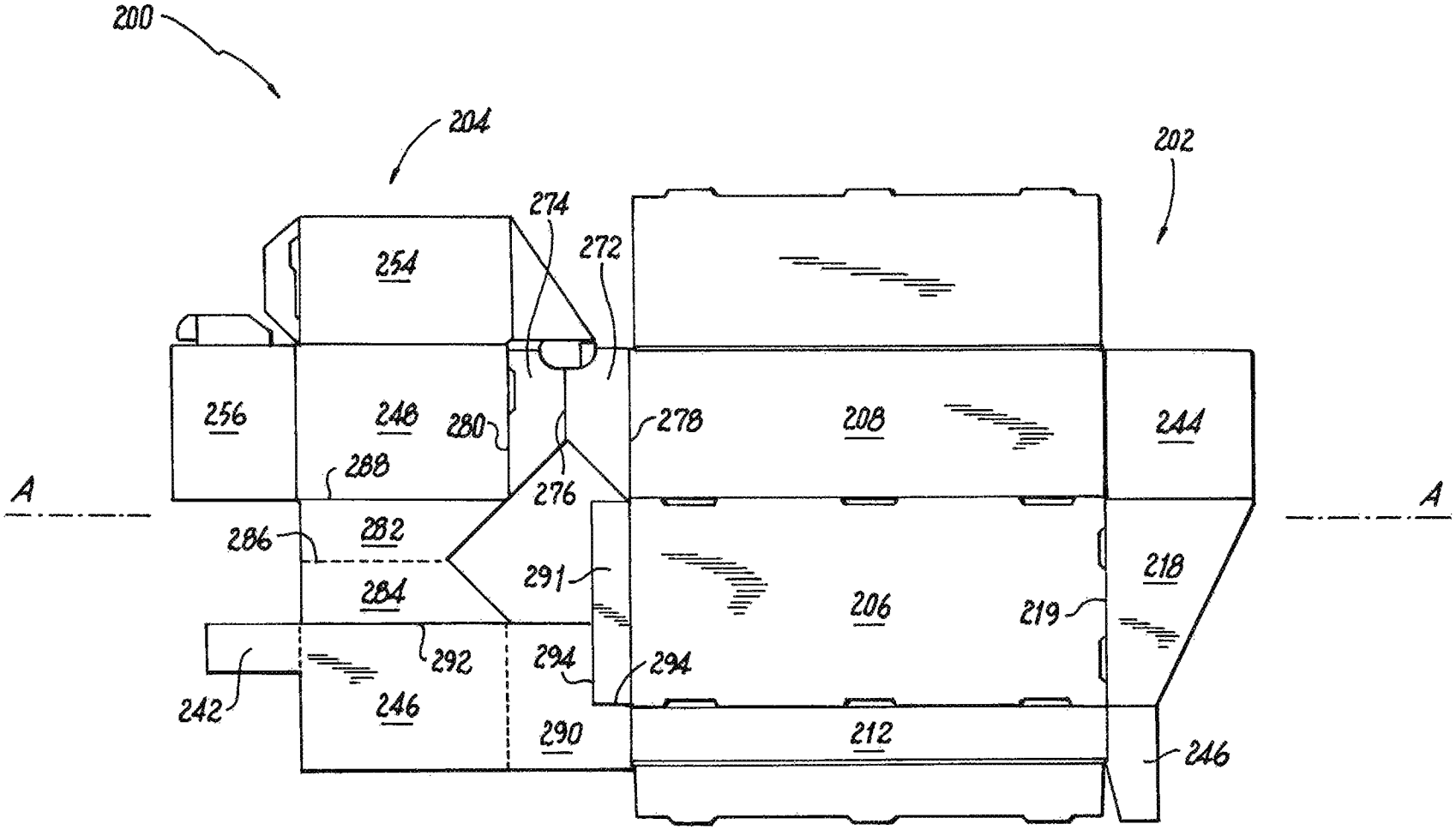
FIG. 4 is a plan view of another exemplary embodiment of a package blank constructed in accordance with the present disclosure, showing the telescoping panels.

With reference now to FIG. 4, another embodiment of a blank 200 is shown for forming the package 201 shown with its graphic block 204 in a compact position relative to its tray 202 in FIG. 5, and in a telescopically expanded position shown in FIG. 6. The tray 202 includes a bottom panel 206, front panel 212, and back panel 208 similar to those described above with respect to blank 100. Side panel 218 is connected to bottom panel 206 along a fold line 219, unlike side panel 118 described above, which is connected to back panel 108 by fold line 119. Tab 246 is assembled and/or adhered in front panel 212, and tab 244 is assembled and/or adhered into back panel 208. The other side panel 216 of tray is connected to a flap 290 which is separated from tray 202 by a cut line 294. When package 201 is assembled as shown in FIGS. 5 and 6, flap 290 is assembled and/or adhered into back panel 208, and tab 242 is assembled and/or adhered in front panel 212.

While the one-piece telescoping capability of package 201 is similar to that described above with respect to blank 100, the folding panels are configured differently. The set of folding panels in blank 200 includes a pair of folding panels 272 and 274 connected to each other along a fold line 276. A first one of the folding panels 272 is integrally connected to a back panel 208 of the tray 202 along a fold line 278. A second one of the folding panels 274 is connected to the side panel 248 of the graphic block along a fold line 280 so that the pair of folding panels 272 and 274 unfolds in accordion expansion as the graphic block 204 slides to telescopically expand along the telescoping axis A relative to its tray 202. The set of folding panels also includes a second pair of folding panels 282 and 284 connected to each other along a fold line 286. A first one of the folding panels 282 is connected to the side panel 248 of the graphic block 204 along a fold line 288. A second one of the folding panels 284 is configured to be connected to a bottom panel 206 and/or a side panel 216 of the tray 202, e.g. folding panel 284 is connected to side panel 216 along fold line 292, and side panel 216 is adhered to bottom panel 206 by way of tab 291 extending from bottom panel 206.

The second pair of folding panels 282 and 284 forms a bottom panel of the graphic block 204 with the folding panels unfolded as shown in FIG. 6. The first pair of folding panels 272 and 274 forms a back panel of the graphic block 204 with the folding panels unfolded as shown in FIG. 6.

The methods and systems of the present disclosure, as described above and shown in the drawings, provide for telescoping graphic block packaging with superior properties including one-piece construction. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for a telescoping graphic block package comprising:

a plurality of panels for forming a tray configured to package and display product placed therein;

a plurality of panels for forming a graphic block slidingly connected to the tray for telescoping relative to the tray along a telescoping axis; and a set of folding panels connecting the tray to the graphic block;

wherein the set of folding panels includes a first pair of folding panels connected to each other along a fold line, wherein a first one of the folding panels in the first pair is connected to a bottom panel of the tray along a fold line, and wherein a second one of the folding panels in the pair is connected to a side panel of the graphic block along a fold line so that the pair of folding panels unfolds in accordion expansion as the graphic block slides to telescopically expand along the telescoping axis; and a second pair of folding panels connected to each other along a fold line, wherein a first one of the folding panels in the second pair is connected to a side panel of the graphic block along a fold line, and a second one of the folding panels in the second pair is connected to a flap configured to be connected to a back panel of the tray.

2. The blank as recited in claim 1, wherein the tray includes a bottom panel, a back panel connected to the bottom panel along a fold line, and a front panel connected to the bottom panel along a fold line across from the back panel, and two side panels on opposite sides of the bottom panel.

3. The blank as recited in claim 1, wherein the graphic block includes a side panel, a front panel connected to the side panel along a fold line, and a top panel connected to the side panel along a fold line such that when the blank is formed into the package, the side panel is orthogonal to both the front panel and the top panel, wherein the side panel of the graphic block is normal to a telescoping axis of the package.

4. The blank as recited in claim 1, wherein the first pair of folding panels is configured to form a bottom panel of the graphic block with the folding panels unfolded, and the second pair of folding panels is configured to form a back panel of the graphic block with the folding panels unfolded.

5. The blank as recited in claim 1, wherein the set of folding panels includes a pair of folding panels connected to each other along a fold line, wherein a first one of the folding panels in the pair is connected to a back panel of the tray along a fold line, and wherein a second one of the folding panels in the pair is connected to a side panel of the graphic block so that the pair of folding panels unfolds in accordion expansion as the graphic block slides to telescopically expand along the telescoping axis; and a second pair of folding panels connected to each other along a fold line, wherein a first one of the folding panels in the second pair is connected to the side panel of the graphic block along a fold line, and wherein a second one of the folding panels in the second pair is configured to be connected to a bottom panel and/or a side panel of the tray.

6. The blank as recited in claim 5, wherein the second pair of folding panels is configured to form a bottom panel of the graphic block with the folding panels unfolded, and wherein the first pair of folding panels is configured to form a back panel of the graphic block with the folding panels unfolded.

7. The blank as recited in claim 1, wherein the tray and graphic block are integrally connected together by the set of folding panels as one piece.

8. A method of forming a telescoping graphic block package from a blank comprising:

forming a tray and a graphic block from a single blank, wherein the graphic block is slidingly connected to the tray for telescoping relative to the tray along a telescoping axis, wherein the tray and the graphic block are integrally connected to each other along at least one fold line;

wherein forming the tray and graphic block includes:

accordion folding a first pair of folding panels to cover a portion of the tray with the graphic block in an unexpanded position, wherein the first pair of folding panels is integrally connected to the tray and to the graphic block along respective fold lines; and accordion folding a second pair of folding panels, wherein the second pair of folding panels is only integrally connected to the tray and to the graphic block along a respective fold line, and is adhered to the other of the tray and graphic block.

* * * * *